US005937451A

United States Patent [19]

Mihara

[11] Patent Number: 5,937,451

[45] Date of Patent: Aug. 17, 1999

[54] BIDET APPARATUS

[76] Inventor: Kenji Mihara, C/O Mihara Co., Ltd Urban Kit 3F, 4-11 Tachibana-dori Higashi 1-chome, Miyazaki 880, Japan

[21] Appl. No.: 08/849,817

[22] PCT Filed: Oct. 16, 1995

[86] PCT No.: PCT/JP95/02079

§ 371 Date: Jun. 16, 1997

§ 102(e) Date: Jun. 16, 1997

[87] PCT Pub. No.: WO96/22722

PCT Pub. Date: Aug. 1, 1996

[30] Foreign Application Priority Data

Jan. 25, 1995 [JP] Japan ..... 7-44709

[51] Int. Cl.[6] ..... A61H 35/00

[52] U.S. Cl. ..... 4/448; 4/443; 289/583; 289/586

[58] Field of Search ..... 4/420.4, 448, 443, 4/515, 516, 518; 239/586, 583; 604/239, 275, 278, 279, 310, 311; 251/321, 324, 326; 401/278–280

[56] References Cited

U.S. PATENT DOCUMENTS

| | | | |
|---|---|---|---|
| 543,969 | 8/1895 | Santee | 251/324 |
| 990,179 | 4/1911 | Wilson | 239/586 |
| 1,606,156 | 11/1926 | Elzi | 401/278 |
| 2,265,080 | 12/1941 | Mezey | 4/448 |
| 3,042,312 | 7/1962 | Packard | 239/586 |
| 4,212,300 | 7/1980 | Meals | 251/321 |
| 4,287,618 | 9/1981 | Silver | 4/443 |
| 4,622,704 | 11/1986 | Chung | 4/448 |
| 5,360,172 | 11/1994 | Wang | 239/583 |

FOREIGN PATENT DOCUMENTS

| | | | |
|---|---|---|---|
| 2061934 | 3/1993 | Canada | 4/443 |

*Primary Examiner*—Henry J. Recla
*Assistant Examiner*—Tuan Nguyen
*Attorney, Agent, or Firm*—Sheridan Ross P.C.

[57] ABSTRACT

An inexpensive bidet having a simple structure for heating and pressurizing washing water and having a good operability and a good washing ability. A three-way valve (51) is provided in a mixture plug (5) in a bathroom so that the mixing plug (5) branches into three ways a hose (7), a faucet (53) and a water temperature ascertaining port (54). A bidet (1) is connected to the mixing plug (5) via a hose (7). The bidet (1) is formed by a grip section (2), a washing water conduction pipe (21), a nozzle (3) at the free end of the grip section (2), and a valve rod (4). The washing water is supplied simultaneously to the hose (7) and the water temperature ascertaining port (54) via the three-way valve (51). The flow rate of the washing water is regulated by the valve rod (4).

11 Claims, 6 Drawing Sheets

(a)

(b)

BIDET APPARATUS

FIELD OF THE INVENTION

This invention is related to a bidet apparatus used for the wash of the vagina wall and the pudendum of a woman.

BACKGROUND OF THE INVENTION

The general conventional bidet apparatus is a toilet bowl (so-called "washable lavatory") which equips the bidet and a bidet for the carrying. The bidet for the carrying comprises a bottle made from the flexible synthetic resin and a nozzle installed on the end of the bottle. A bottle of a bidet for carrying is pressed with a hand to spout out wash liquid from the nozzle to use.

However, the toilet bowl type needs a tank and a pump for wash water. Means for heating of wash water is necessary, because tepid water is more desirable for washing, therefore control devices must be provided with the conventional bidet. Therefore, the whole toilet bowl requires a complicated structure and becomes expensive. A carrying bidet has a disadvantage that enough spout power can not be obtained therefrom, since it depends on the grip of a hand. The washing ranges of both the toilets bowl type and the carrying-type, are only the exposed parts of the human body. The conventional bidets do not have the function to wash a vagina wall.

It is an object of the present invention to provide a bidet apparatus that may be produced cheaply by simplifying the composition of the heating mechanism and the pressurization mechanism, thereof. Additionally, the bidet apparatus can wash a vagina wall efficiently because of its good operability, and the sufficient wash ability, thereof.

SUMMARY OF THE INVENTION

The bidet apparatus of the present invention comprises a grip section having a washing water conduction pipe therein, and a spout nozzle having spout holes to spout the washing water which is sent from the faucet. The washing water conduction pipe branches from the watering route of the faucet and the spout nozzle is fitted on the free end of the grip section. Whereby, the structure of the heating and the pressurization mechanism of wash water can be simplified and enough wash ability can be obtained.

The flow rate of the washing water, which flows through the washing water conduction pipe, can be adjusted by the operable valve that is provided at the washing water conduction pipe of the grip section. Whereby, the present bidet apparatus has good operability and can wash the vagina wall efficiently by the desirable flow rate.

DETAILED DESCRIPTION

Figure 3:
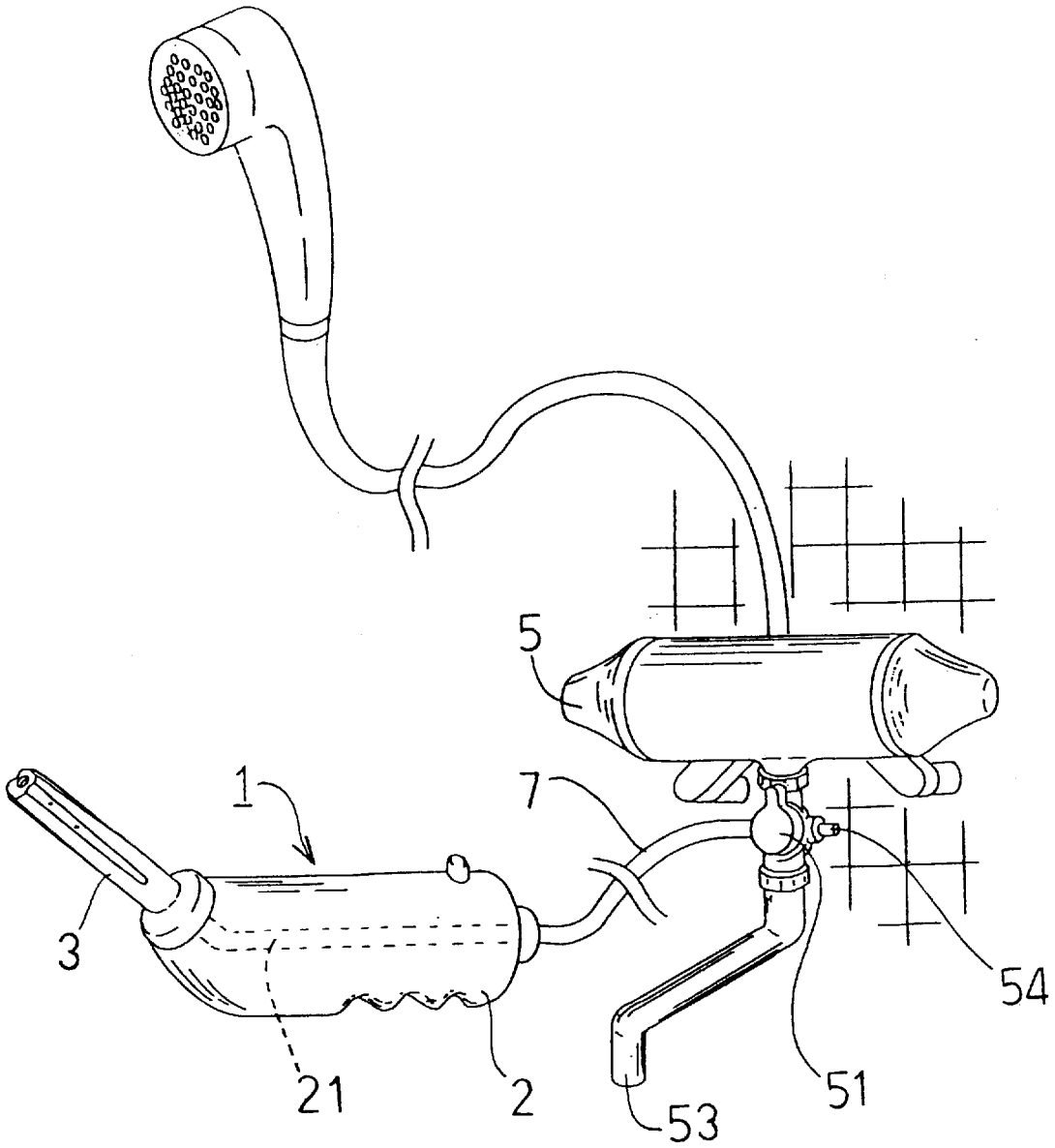
FIG. 3 is the perspective view illustrating the installation of a bidet on the faucet.

As shown in FIG. 3, this bidet apparatus comprises a three-way valve 51, which is provided for a mixture plug 5 at the bathroom, and a bidet 1 connected to the three-way valve 51. The hot water, which is supplied from mixture plug 5, is branched in three directions by the three-way valve 51 to the bidet 1, to a faucet 53 and to a water temperature ascertaining port 54.

The bidet 1 consists of a grip section 2 having a washing water conduction pipe 21 inside thereof, and the nozzle 3 fitted on the free end of the grip section 2, which spouts washing water. The bidet 1 is equipped with a flow rate adjustment function that adjusts the spout quantity of the washing water, and the bidet 1 is connected to the mixture plug 5 through a hose 7.

The connection of the bidet 1 to the mixture plug by the three-way valve 51 can also be connected to the shower side, if any, of another mixture plug.

To describe this invention in detail, each embodiment is explained according to the attached drawings.

Embodiment 1

Figure 1:
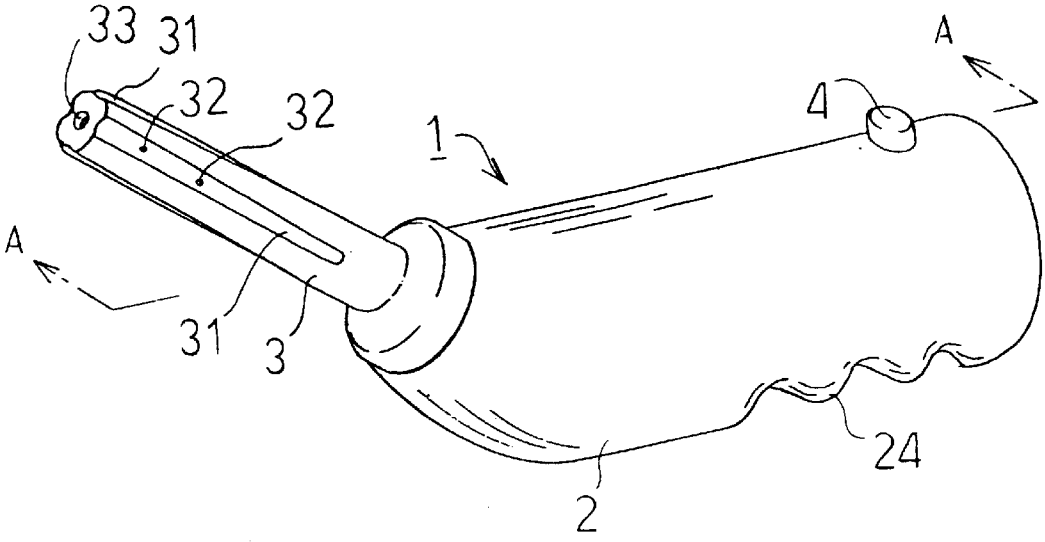
FIG. 1 is the perspective view of the bidet of Embodiment 1.

As shown in FIG. 1, the bidet 1 of Embodiment 1 is composed of nearly pipe-shaped grip section 2, the nozzle 3 installed in the free end of the grip section 2, and the valve rod 4 which adjusts flow rate.

Figure 2:
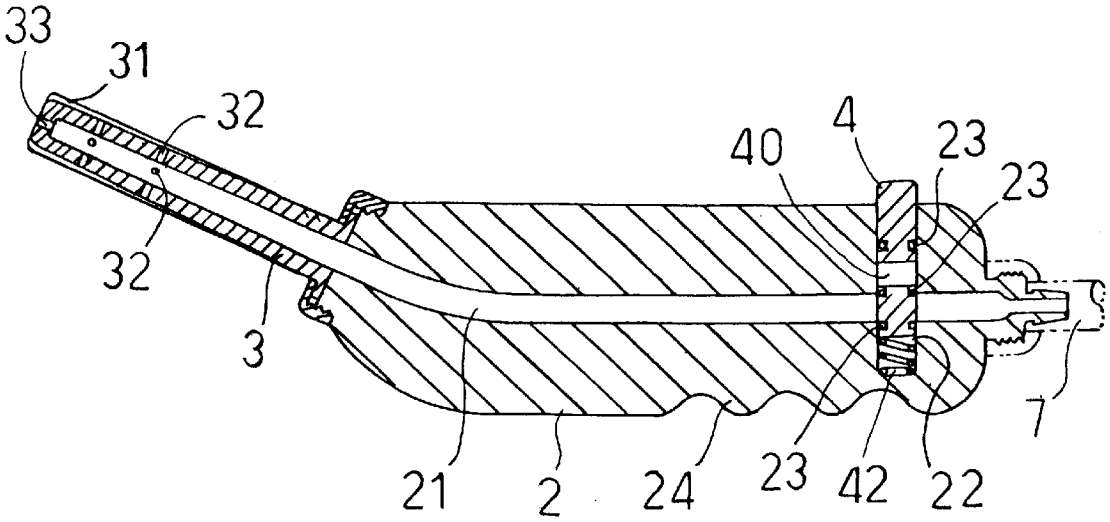
FIG. 2 is the A—A section view of FIG. 1.

As shown in FIG. 2, the washing water conduction pipe 21 is provided inside of grip section 2 and curves as to have upward angle at its front-end to connect to nozzle 3. The rear-end of the bidet 1 communicates with a mixture plug 5 through the hose 7 (See FIG. 5).

A valve rod insertion hole 22 is bored into the inside of grip section 2 from the periphery thereof. The valve rod insertion hole 22 perpendicularly crosses with the washing water conduction pipe 21. A valve rod 4 is stored in this valve rod insertion hole 22. A spring 42 is installed at the underside of valve rod 4. Thereby, the valve rod 4 is held in valve rod insertion hole 22 and is pressed against outside of the grip section 2 by the spring 42. A washing water conduction hole 40 is horizontally bored breadthways through the middle of the valve rod 4. Whereby, a washing water conduction hole 40 is communicated with the washing water conduction pipe 21 by pushing down the valve rod 4 to cause the washing water to spout from nozzle 3. O-rings 23 are located around the valve rod 4 above and below the washing water conduction hole 40 to prevent washing water to flow into the valve rod insertion hole 22 from the washing water conduction pipe 21. A grasp 24 is formed at the bottom of grip section 2, so as not to slip even if the grip section 2 is grasped with a wet hand to push the valve rod 4.

As shown in FIGS. 1 and 2, the nozzle 3 is made from flexible synthetic resin and its surface is smooth. The nozzle 3 is formed in stick-shape for insertion into the vagina. Four grooves 31 are formed on the surface of the nozzle 3 along its lengthwise direction. In each groove 31, two spout holes 32 are respectively bored in a row. Also, a spout hole 33 is bored in the tip of the nozzle 3 to deeply wash the inside of the vagina.

Figure 4:
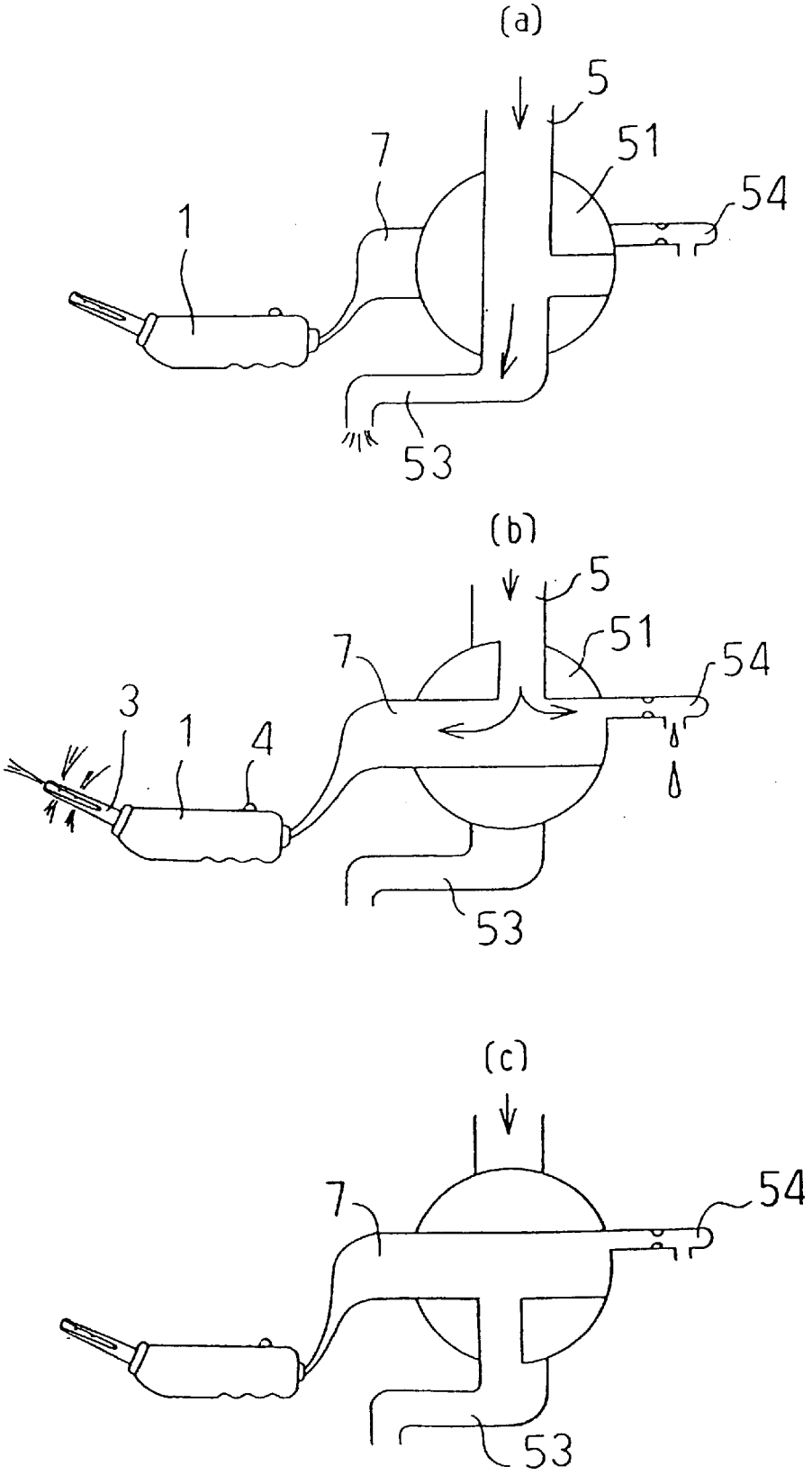
FIG. 4 is the diagrammatic illustration showing the changing of the watercourse by the three-way valve.

The watering controlled by the three-way valve 51 is hereby described. As shown in FIG. 4(*a*), the three-way valve 51 is turned to let the mixture plug 5 communicate with the faucet 53 to allow water to be supplied to faucet 53.

Meanwhile, the watercourses to the hose 7 and the water temperature ascertaining port 54 are closed.

As shown in FIG. 4(*b*), the three-way valve 51 closes the watercourse to faucet 53, and the watercourses to hose 7 and water temperature ascertaining port 54 are simultaneously opened. Thereby, watering to bidet 1 and water temperature ascertaining port 54 is established at the same time. A small quantity of washing water pours from the water temperature ascertaining port 54, since the path for the plumbing is narrowly formed. Thereby, the washing water temperature can be confirmed, by touching with a hand a small quantity of washing water which pours from water temperature ascertaining port 54, before operating the valve rod 4.

Accordingly, even if extremely hot water exits from the mixture plug 5 due to problems with the thermostat or by mistake, extremely hot water never suddenly spouts from nozzle 3. This feature ensures that burns can be prevented by operating the valve rod 4 only after the temperature of the washing water is confirmed. FIG. 4(*c*) shows that hose 7, faucet 53 and water temperature ascertaining port 54 are completely closed.

Embodiment 2

Figure 5:
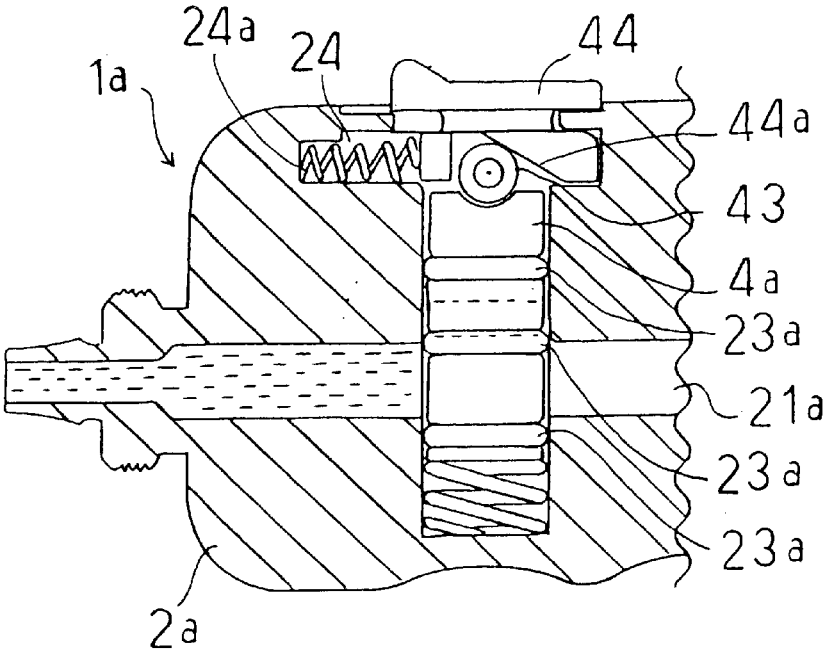
FIG. 5 is the partial sectional side elevation which shows a watercourse inside the bidet of Embodiment 2.
Figure 5:
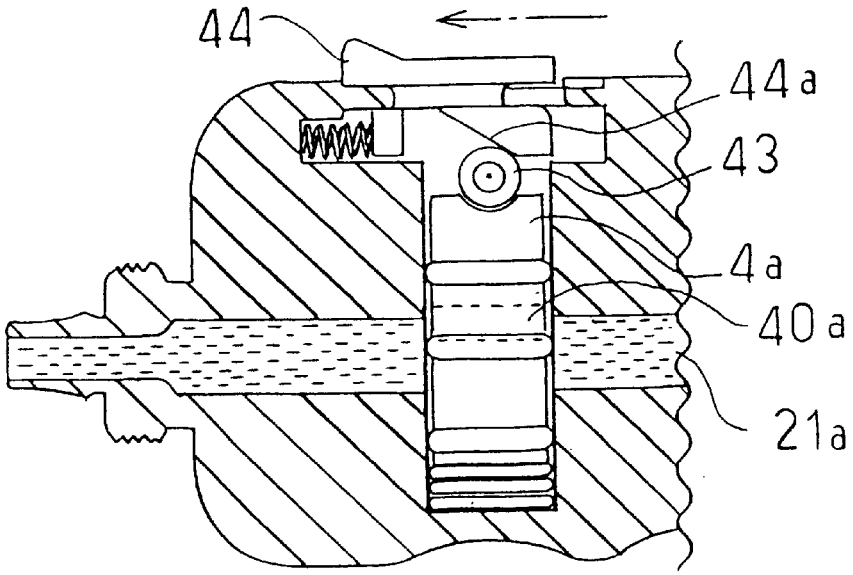

As shown in FIG. 5(*a*), the flow rate adjustment function of bidet 1*a* of Embodiment 2 comprises a valve rod 4*a,* a bearing 43 and a slide knob 44. O-rings 23*a* surround the valve rod 4*a*. The bearing 43 is mounted on the top part of valve rod 4*a*. The slide knob 44 moves valve rod 4*a* up and down by pressing bearing 43 thereby.

The slide knob 44 is provided at the upper part of grip section 2*a* to move backward and forward. A spring 24*a* is stored in a spring storage chamber 24 of the rear part of grip section 2*a,* and presses the slide knob 44 forward. A slope 44*a* is formed at the bottom surface of slide knob 44 to contact with the bearing 43. When the slide knob 44 is in the forward position, the valve rod 4*a* is held in the upper position where washing water conduction pipe 21*a* is closed.

As shown in FIG. 5(*b*), the slope 44*a* pushes down the bearing 43 when the slide knob 44 is moved backward, and accordingly, the valve rod 4*a* slides down. The washing water conduction hole 40*a* of valve rod 4*a,* then, communicates with the washing water conduction pipe 21*a,* and washing water is supplied to the nozzle (not illustrated).

Embodiment 3

Figure 6:
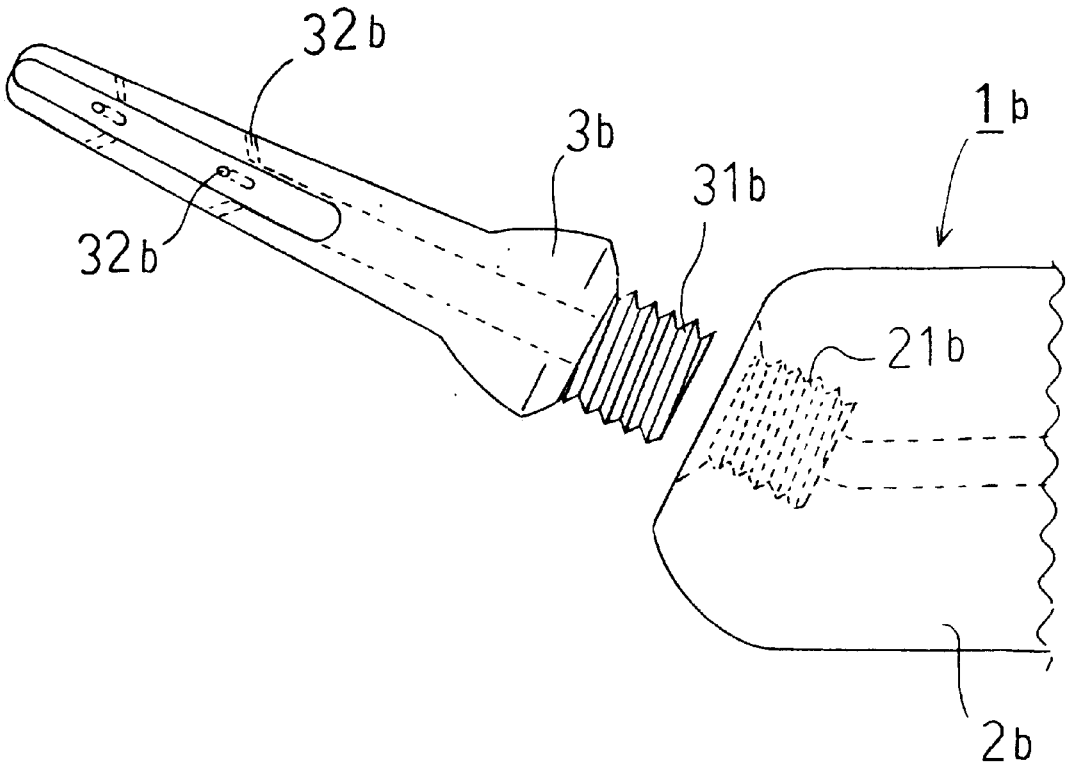
FIG. 6 is a partial side view of a bidet of Embodiment 3.

As shown in FIG. 6, the nozzle 3*b* of the bidet 1*b,* in Embodiment 3, is made of elastic resin, such as silicone rubber. The male screws 31*b* of nozzles 3*b* turns into the bore 21*b* formed at the free end of grip section 2*b* to install.

According to this installation structure, the male screw 31*b* expands when water pressure is taken inside of nozzle 3*b*. Whereby, the nozzle 3*b* is prevented from separating from the grip section 2*b,* since the male screw 31*b* attaches to the bore 21*b*.

In this embodiment, the male screw 31*b* is at nozzle 3*b* and the bore 21*b* is in grip section 2*b*. To obtain similar effect, however, an opposite structure to the above would be available, i.e., a male screw can be provided on the grip section and a bore provided in the nozzle.

The spout holes 32*b* are bored on an incline to the direction nozzle to cause the washing water to flow forward from side of the vagina wall. Thereby, the vagina wall can be washed more efficiently.

Embodiment 4

Figure 7:
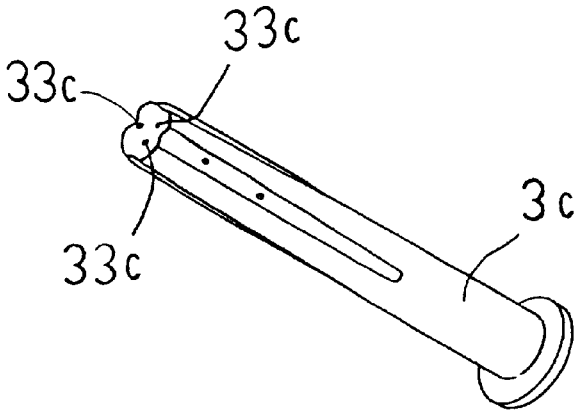
FIG. 7 is the perspective view showing a nozzle of the bidet of Embodiment 4.

As shown in FIG. 7, the nozzle 3*c* of Embodiment 4 has three spout holes 33*c* on the tip surface thereof arranged in nearly a triangle. The washing water is dispersed and spouts out from the tip of the nozzle 3*c* to allow the back of the vagina wall to be washed more efficiently.

Embodiment 5

Figure 8:
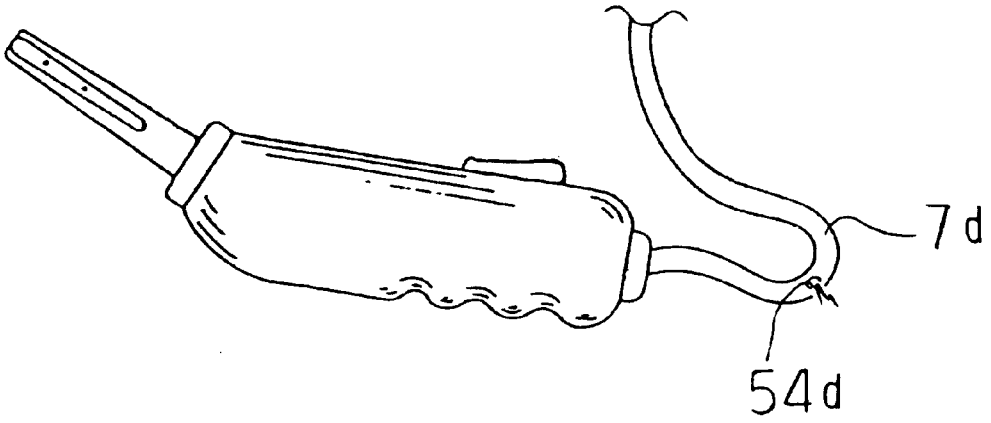
FIG. 8 is the partial perspective view of a bidet apparatus of Embodiment 5.

In the bidet apparatus of Embodiment 1, the water temperature ascertaining port 54 was provided adjacent to the three-way valve 51 which is installed below the mixture plug 5. In Embodiment 5, a water temperature ascertaining port 54*d* is provided on a hose 7*d* as shown in FIG. 8. Thereby, the hand opposite from the hand grasping a bidet is not necessarily extended in the unreasonable posture.

Embodiment 6

Figure 9:
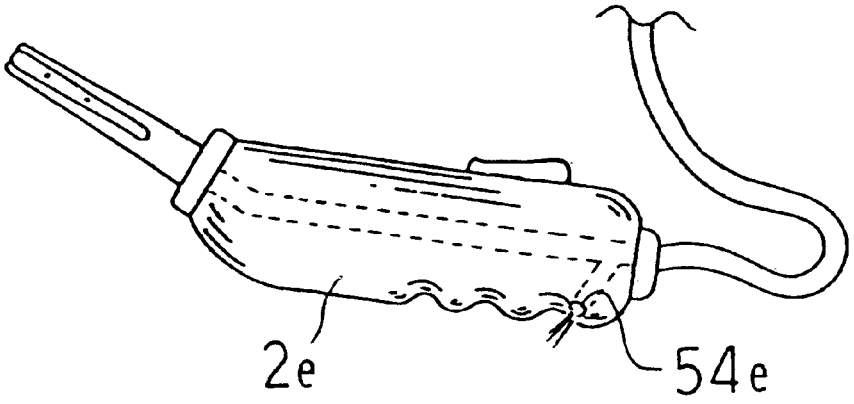
FIG. 9 is the partial perspective view of a bidet apparatus of Embodiment 6.

In Embodiment 6, as shown in FIG. 9, a water temperature ascertaining port 54*d* is provided on a grip section 2*e*. Thereby, the temperature of the washing water can be directly confirmed with the hand grasping grip section 2*e*.

The present invention provides the following effects:

(1) Since the watering route of the faucet is branched to the bidet with the three-way valve to supply washing water, the efficient flow rate of washing water can be obtained. The nozzle, which spouts washing water, can be inserted in the vagina, and, thereby, the vagina wall can be washed over a wide area, thereof.

(2) The washing water provided to the bidet can be easily directed to the desired spout by the valve, which adjusts the flow rate.

(3) Since it is possible to confirm the water temperature with a small quantity of washing water from the water temperature ascertaining port, a burn can be prevented, even if water temperature setting by the mixture plug is incorrect.

Application for the Industry

The bidet apparatus of this invention can be inexpensively and easily installed to a faucet in a bathroom at home, in a hotel and so on, and the apparatus can contribute to a more comfortable and sanitary living environment.

What is claimed is:

1. A bidet apparatus comprising;

a hose;

a grip section having an end connected to said hose, a middle portion, and a free end, wherein said grip section comprises (i) a washing water conduction pipe positioned within said grip section, said washing water conduction pipe communicating with said hose, and (ii) a valve, wherein said valve is operable by selectively depressing a valve rod in a direction transverse to said washing water conduction pipe, wherein said valve is biased to a closed position, and wherein said valve and valve rod are disposed at a point in said middle portion of said grip section;

a spout nozzle communicating with said washing water conduction pipe and having at least one spout hole thereon, said spout nozzle is provided on said free end of said grip section, whereby washing water spouts from said spout hole when said valve rod is depressed; and a water temperature ascertaining port that is operable when water is supplied to said hose, and that has a flow passage sized such that water from said water temperature ascertaining port flows at a rate that is less than a maximum flow supplied to said washing water conduction pipe.

2. The bidet, according to claim 1, further comprising:

said grip section having a valve-rod insertion hole transverse to the major axis of said grip section;

said valve rod being positioned within said valve rod insertion hole; whereby a flow rate from said spout hole may be regulated by the thumb of the hand of the user that is gripping said grip section.

3. The bidet, according to claim 1, wherein the angle between said spout nozzle and said grip section is oblique.

4. The bidet, according to claim 1, wherein a plurality of spout holes is provided on a side of said spout nozzle.

5. The bidet, according to claim 4, wherein at least one of said plurality of spout holes in said side of the spout nozzle inclines toward a tip of said spout nozzle.

6. The bidet, according to claim 4, wherein at least one spout hole is provided on a tip surface of said spout nozzle.

7. The bidet, according to claim 5 wherein, at least three of said plurality of spout holes on said tip surface of said spout nozzle are arranged in nearly a triangle.

8. The bidet, according to claim 1, further comprising:

a first threaded portion provided on said free end of said grip section; and a second threaded portion provided on an end opposite an end including said tip surface of said spout nozzle, whereby said spout nozzle is connected to said grip section by threadibly attaching said first threaded portion with said second threaded portion.

9. The bidet, according to claim 1, further comprising:

at least one O-ring positioned around said valve rod.

10. The bidet, according to claim 1, wherein said grip section has a top side and a bottom side, and wherein said bottom side features at least one depression for receiving a finger of a user.

11. A bidet apparatus comprising:

a hose;

a grip section having a washing water conduction pipe inside thereof, said washing water conduction pipe communicating with a watering route as a branch of a water stopper apparatus;

a spout nozzle having at least one spout hole thereon, said spout nozzle is provided on said free end of said grip section, whereby washing water spouts from said spout hole when said valve rod is depressed;

a valve rod insertion hole bored from an inside to an outside of said grip section; and said valve rod having a conduction hole; wherein said valve rod insertion hole crosses with said washing water conduction pipe, said valve rod is stored in said valve rod insertion hole, said conduction hole is bored breadthways through said the valve rod, and said valve rod is pressed against said outside of said grip section; whereby a flow rate in said washing water conduction pipe is adjusted by sliding said valve rod up and down;

a slide knob having a sloped bottom, said slide knob positioned above said valve rod; and a bearing positioned between a top portion of said valve rod and said slide knob, wherein said bearing contacts said sloped surface and said valve rod during regulation of the flow rate in said washing water conduction pipe.

* * * * *